US009726098B2

(12) United States Patent
Shirasaki et al.

(10) Patent No.: US 9,726,098 B2
(45) Date of Patent: Aug. 8, 2017

(54) INTAKE AIR MASS ESTIMATION APPARATUS FOR MOTORCYCLE

(71) Applicant: Mitsubishi Electric Corporation, Tokyo (JP)

(72) Inventors: Mitsuaki Shirasaki, Tokyo (JP); Kenichi Yamagata, Tokyo (JP); Masahiko Nomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 50 days.

(21) Appl. No.: 14/804,710

(22) Filed: Jul. 21, 2015

(65) Prior Publication Data

US 2016/0298561 A1 Oct. 13, 2016

(30) Foreign Application Priority Data

Apr. 8, 2015 (JP) ..... 2015-078899

(51) Int. Cl.
*F02D 41/18* (2006.01)
*F02B 61/02* (2006.01)
(Continued)

(52) U.S. Cl.
CPC ..... *F02D 41/18* (2013.01); *F02B 61/02* (2013.01); *F02D 41/009* (2013.01);
(Continued)

(58) Field of Classification Search
CPC ..... F02D 2200/0406; F02D 2200/0404; F02D 2200/0408; F02D 35/026; F02D 41/0045; F02D 2200/04; F02D 2200/0416
(Continued)

(56) References Cited

U.S. PATENT DOCUMENTS 5,477,826 A 12/1995 Hara et al.
7,225,793 B2 * 6/2007 Schwulst ..... F02D 41/009 123/406.22
(Continued)

FOREIGN PATENT DOCUMENTS

JP 05-222998 A 8/1993
JP 5-321743 A 12/1993
(Continued)

OTHER PUBLICATIONS

Communication dated Apr. 5, 2016 from the Japanese Patent Office in counterpart application No. 2015-078899.

*Primary Examiner* — Stephen K Cronin
*Assistant Examiner* — Long T Tran
(74) *Attorney, Agent, or Firm* — Sughrue Mion, PLLC; Richard C. Turner

(57) ABSTRACT

An intake air mass estimation unit is provided that sets predetermined degrees of crank angle to an angle that can divide an intake stroke into a plurality of sections, measures at every the predetermined degrees of crank angle the pressure downstream of the throttle valve and the time taken for the predetermined degrees of crank angle rotation, estimates the intake air mass flowing from the upstream to downstream of the throttle valve at every the predetermined degrees of crank angle, using the pressure downstream of the throttle valve and the time taken for the predetermined degrees of crank angle rotation measured at every the predetermined degrees of crank angle, and integrates the intake air mass at every the predetermined degrees of crank angle for 720 degrees of crank angle rotation, thereby estimating the intake air mass needed for one combustion.

8 Claims, 10 Drawing Sheets

(51) Int. Cl.
*F02D 41/00* (2006.01)
*F02D 41/28* (2006.01)

(52) U.S. Cl.
CPC ..... *F02D 2041/286* (2013.01); *F02D 2200/0402* (2013.01); *F02D 2200/0404* (2013.01); *F02D 2200/0406* (2013.01); *F02D 2200/0414* (2013.01); *F02D 2200/101* (2013.01)

(58) Field of Classification Search
USPC ..... 123/184.21; 701/101–105
See application file for complete search history.

(56) References Cited

U.S. PATENT DOCUMENTS 7,720,591 B2 * 5/2010 Takamiya ..... F01L 1/34 123/399
7,769,523 B2 * 8/2010 Matsushima ..... F02D 41/047 123/480
7,953,529 B2 * 5/2011 Takamiya ..... F01L 1/34 701/103
8,224,559 B2 * 7/2012 Chang ..... F02D 41/0087 123/479
8,909,456 B2 * 12/2014 Ueda ..... F02D 13/0207 701/105
8,949,004 B2 * 2/2015 Ishigami ..... F02D 41/0005 123/568.21
2006/0157024 A1 * 7/2006 Tomii ..... F02D 9/02 123/346
2008/0215229 A1 * 9/2008 Matsushima ..... F02D 41/047 701/103
2008/0245229 A1 * 10/2008 Buschbeck ..... B22D 19/0027 92/186
2012/0316758 A1 * 12/2012 Ueda ..... F02D 13/0207 701/105
2014/0116376 A1 * 5/2014 Hagari ..... F02D 41/182 123/319
2014/0121947 A1 * 5/2014 Komuro ..... F02D 41/18 701/103

FOREIGN PATENT DOCUMENTS

JP 2004-339958 A 12/2004
JP 2004-340022 A 12/2004
JP 2006-22697 A 1/2006
JP 2006-37911 A 2/2006
JP 2006-037911 A 2/2006
JP 2008-144641 A 6/2008

* cited by examiner

INTAKE AIR MASS ESTIMATION APPARATUS FOR MOTORCYCLE

BACKGROUND OF THE INVENTION

Field of the Invention

The present invention relates to an intake air mass estimation apparatus for motorcycle that views a throttle valve provided in an intake passage of an engine for motorcycle as an orifice (aperture) to estimate the air mass passing through the orifice.

Description of the Related Art

Conventionally, as a method for estimating the intake air mass for an motorcycle, a throttle speed method (a method of estimating the intake air mass from the throttle opening and the engine rotation speed) or a speed density method (a method of estimating the intake air mass from the intake pressure and the engine rotation speed) or both have been used. In recent years, with the tightened exhaust gas regulation and requirements of the marketplace for fuel efficiency improvement, there has been a need for accurate measurement of the intake air mass for proper fuel injection. A known method for accurately estimating the air mass taken into an engine is an intake air mass estimation method employing a throttle model. Thus, the inventors studied the introduction of a throttle model intake air mass estimation method used for a car into a motorcycle.

In general, a car includes a multi-cylinder engine. A multi-cylinder four-stroke engine for car (an engine that performs intake, compression, combustion and exhaust during 720 degrees of crank angle rotation) is characterized in that a plurality of times of intakes and combustions are performed during 720 degrees of crank angle rotation, that the flywheel is configured to be heavy in order to suppress the rotation fluctuation of the engine, and that a plurality of cylinders are connected to the downstream of the throttle valve or the throttle valve downstream has a large inner volume due to the presence of a surge tank.

In the multi-cylinder engine characterized as above, the rotation fluctuation of the engine (variation in the engine rotation speed during 720 degrees of crank angle rotation) is smoothed by the combustions of the multiple cylinders overlapping with one another each having a phase difference from the adjacent cylinder during 720 degrees of crank angle rotation and the heavy flywheel. Furthermore, the throttle valve downstream pressure fluctuation (variation in the throttle valve intake pressure during 720 degrees of crank angle rotation) is smoothed by the intakes of the multiple cylinders overlapping with one another each having a phase difference from the adjacent cylinder during 720 degrees of crank angle rotation and the large inner volume of the throttle valve downstream functioning as a filter.

Therefore, the throttle model intake air mass estimation is calculated using the average engine rotation speed and the average throttle valve downstream pressure as indicated by the following equation:

$$Q=m(P1,P2\text{ave})*(60/NE\text{ave}).$$

In the above equation, Q is the air mass used for one combustion, P1 is the throttle valve upstream pressure, P2ave is the average throttle valve downstream pressure, m is the mass flow rate of the gas passing through the throttle valve as a function of P1, P2ave, and NEave is the average engine rotation speed.

By the way, for example, JP-A-5-222998 (Patent Document 1) describes a way of viewing a throttle valve as an orifice and estimating the air mass passing through the orifice from the flow passage opening area of the orifice and the pressures of the upstream and downstream of the orifice, based on a fluid mechanics equation. This document also describes a way of estimating the throttle valve downstream pressure depending on the crank angle in order to capture the throttle downstream pressure that varies along with the piston stroke, also taking into consideration the small inner volume of the throttle valve downstream.

JP-A-2006-37911 (Patent Document 2) describes an intake valve model in which the throttle valve downstream pressure is estimated using a throttle model and the intake valve is viewed as an orifice to estimate the air mass passing through the intake valve from the throttle valve downstream pressure, the cylinder internal pressure and the intake valve opening area, in which the case of gas blowing back from the cylinder into the intake passage downstream of the throttle valve is taken into consideration.

[Patent Document 1] JP-A-5-222998

[Patent Document 2] JP-A-2006-37911

Some motorcycles have a single-cylinder engine. In general, a single-cylinder four-stroke engine for motorcycle is characterized in that intake and combustion are performed only once during 720 degrees of crank angle rotation, that the flywheel for suppressing the rotation fluctuation of the engine is lightweight, and that there is no surge tank downstream of the throttle valve and, since there is a short distance from the throttle valve to the cylinder of the engine, the throttle valve downstream has a small inner volume.

In the single-cylinder engine characterized as above, the engine rotation fluctuation occurs because of only one combustion during 720 degrees of crank angle rotation and the lightweight flywheel. Also, the throttle valve downstream pressure fluctuation occurs because of only one intake during 720 degrees of crank angle rotation and the small inner volume of the throttle valve downstream.

Accordingly, there is a problem with a motorcycle having a single-cylinder engine in which the intake air mass cannot be accurately determined through the calculation of the throttle model intake air mass estimation using the average throttle valve downstream pressure and the average engine rotation speed.

However, although the Patent Document 1 takes into consideration the variation in the throttle valve downstream pressure depending on the crank angle, it mentions nothing about the engine rotation fluctuation.

Also, the Patent Document 2 mentions the intake valve model in which the intake valve is viewed as an orifice to determine the air mass flow passing through the opening intake valve by performing integration at predetermined intervals, but it mentions nothing about the throttle model. Thus, it does not describe the estimation of the air mass passing through the throttle valve during 720 degrees of crank angle rotation taking into consideration the throttle valve downstream pressure fluctuation and the engine rotation fluctuation.

Also, the Patent Document 2 mentions the case in which air is blown back from the cylinder into the intake passage downstream of the throttle valve, but it mentions nothing about the case in which air is blown back from the throttle valve downstream to the throttle valve upstream.

SUMMARY OF THE INVENTION

In view of the above, it is an object of the present invention to provide an intake air mass estimation apparatus for motorcycle that views a throttle valve provided in an intake passage of an engine for motorcycle as an orifice (aperture) to estimate the air mass passing through the orifice.

The intake air mass estimation apparatus for motorcycle in accordance with the invention includes: a throttle valve for controlling the air mass taken into a four-stroke engine; a throttle valve upstream pressure detector for detecting the pressure upstream of the throttle valve; a throttle valve downstream pressure detector for detecting the pressure downstream of the throttle valve; a flow passage opening area detector for detecting an entire flow passage area between the upstream side of the throttle valve and the downstream side of the throttle valve; a crank angle detector for detecting a rotated angle from a reference position of a crankshaft of the engine; a crank angle period measuring unit for measuring the time taken for predetermined degrees of crank angle rotation; and an intake air mass estimation unit for viewing the throttle valve as an orifice to estimate the intake air mass estimation value based on the pressure upstream of the throttle valve, the pressure downstream of the throttle valve and the flow passage opening area detected by the flow passage opening area detector, wherein the intake air mass estimation unit sets the predetermined degrees of crank angle to an angle that can divide an intake stroke into a plurality of sections, measures at every the predetermined degrees of crank angle at least the pressure downstream of the throttle valve and the time taken for the predetermined degrees of crank angle rotation, estimates the intake air mass flowing from the upstream of the throttle valve to the downstream of the throttle valve at every the predetermined degrees of crank angle, using the pressure downstream of the throttle valve and the time taken for the predetermined degrees of crank angle rotation measured at every the predetermined degrees of crank angle, and integrates the intake air mass at every the predetermined degrees of crank angle for 720 degrees of crank angle rotation, thereby estimating the intake air mass needed for one combustion.

According to the intake air mass estimation apparatus for motorcycle in accordance with the invention, with the above-described configuration, for a single-cylinder engine, even when the pressure fluctuation downstream of the throttle valve is large and the engine rotation fluctuation is large, the intake air mass needed for one combustion can be accurately estimated.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Preferred embodiments of an intake air mass estimation apparatus for motorcycle in accordance with the invention are described below with reference to the drawings.

First Embodiment

Figure 1:
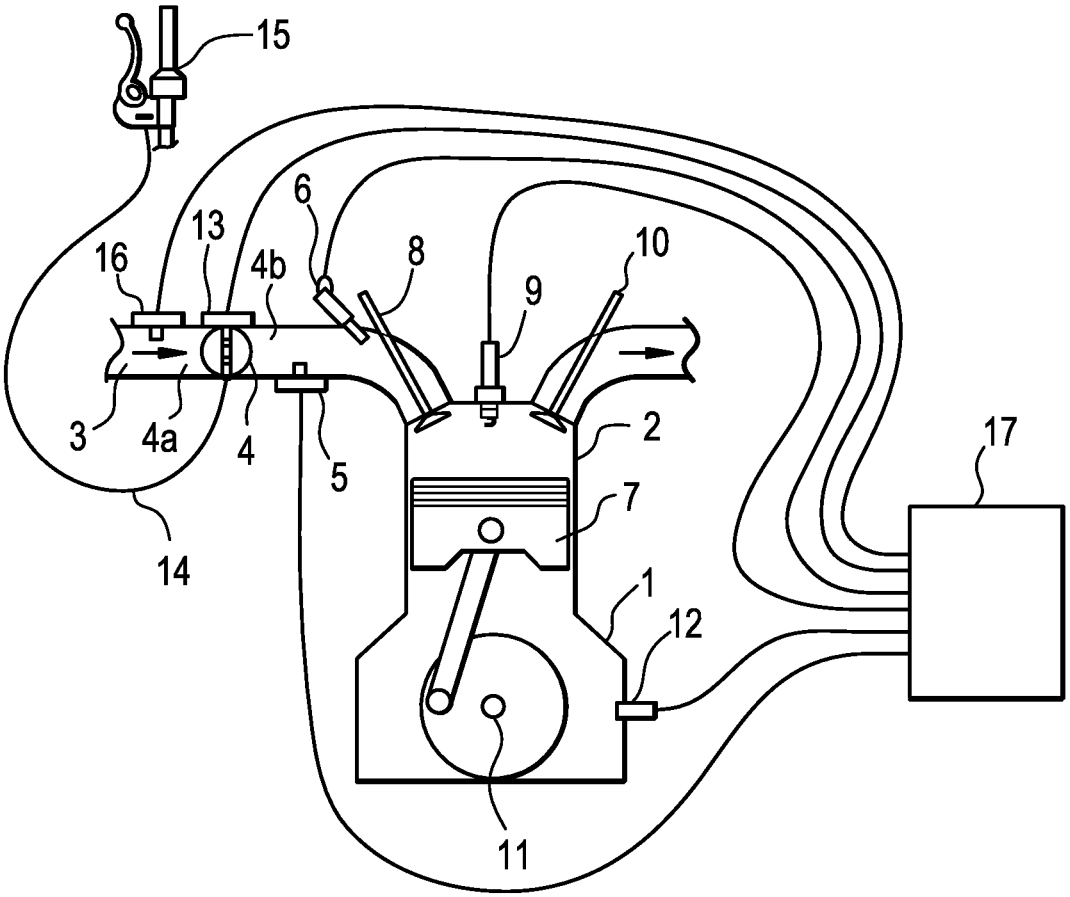
FIG. 1 is a schematic configuration diagram of an engine for motorcycle to which an intake air mass estimation apparatus for motorcycle in accordance with a first embodiment of the invention is applied.

FIG. 1 is a conceptual diagram showing an example of the overall configuration of an intake air mass estimation apparatus for motorcycle in accordance with a first embodiment of the invention. FIG. 1 shows a single-cylinder engine, however, the intake air mass may also be similarly estimated for a multi-cylinder engine.

In FIG. 1, an intake pipe 3 is connected to a cylinder 2 of an engine 1, and a throttle valve 4 for controlling the air mass is provided in the intake pipe 3. Here, the portion designated by the reference numeral 4*a* is referred to as a throttle valve upstream, and the portion designated by the reference numeral 4*b* is referred to as a throttle valve downstream. The throttle valve downstream 4*b* includes: an intake pressure sensor 5 for detecting an internal pressure of the intake pipe 3; and an injector 6 for injecting fuel. The cylinder 2 includes: a piston 7 that performs reciprocating movement caused by the combustion of a mixture of air and fuel; an intake valve 8 for controlling the timing of taking the mixture into the cylinder 2; an ignition plug 9 for igniting the mixture; and an exhaust valve 10 for controlling the timing of exhausting combustion gas from the cylinder 2.

The piston 7 is connected to a crankshaft 11 that performs conversion from reciprocating movement to rotational movement. A crank angle sensor 12 is provided on the side of the engine 1 to detect the rotation angle from a reference position of the crankshaft 11 and the time taken for predetermined degrees of crank angle rotation. A throttle position sensor 13 for detecting the opening of the throttle valve 4 is provided at the throttle valve 4. The opening of the throttle valve 4 is adjusted by a driver operating a throttle grip 15 coupled to the throttle valve 4 by a wire 14. In this embodiment, the driver uses a mechanical throttle for operating the throttle valve 4. However, an electronic throttle for controlling the throttle valve 4 using an actuator, such as a motor, may also be used in place of the mechanical throttle.

An intake temperature sensor 16 for measuring the intake temperature is provided in the throttle valve upstream 4*a*. Signals from the intake pressure sensor 5, the crank angle sensor 12, the throttle position sensor 13 and the intake temperature sensor 16 are input to a control unit 17. Based on the input signals, the control unit 17 calculates the fuel injection amount and the ignition timing to perform the fuel injection control using the injector 6 and the ignition timing control using the ignition plug 9.

Figure 2:
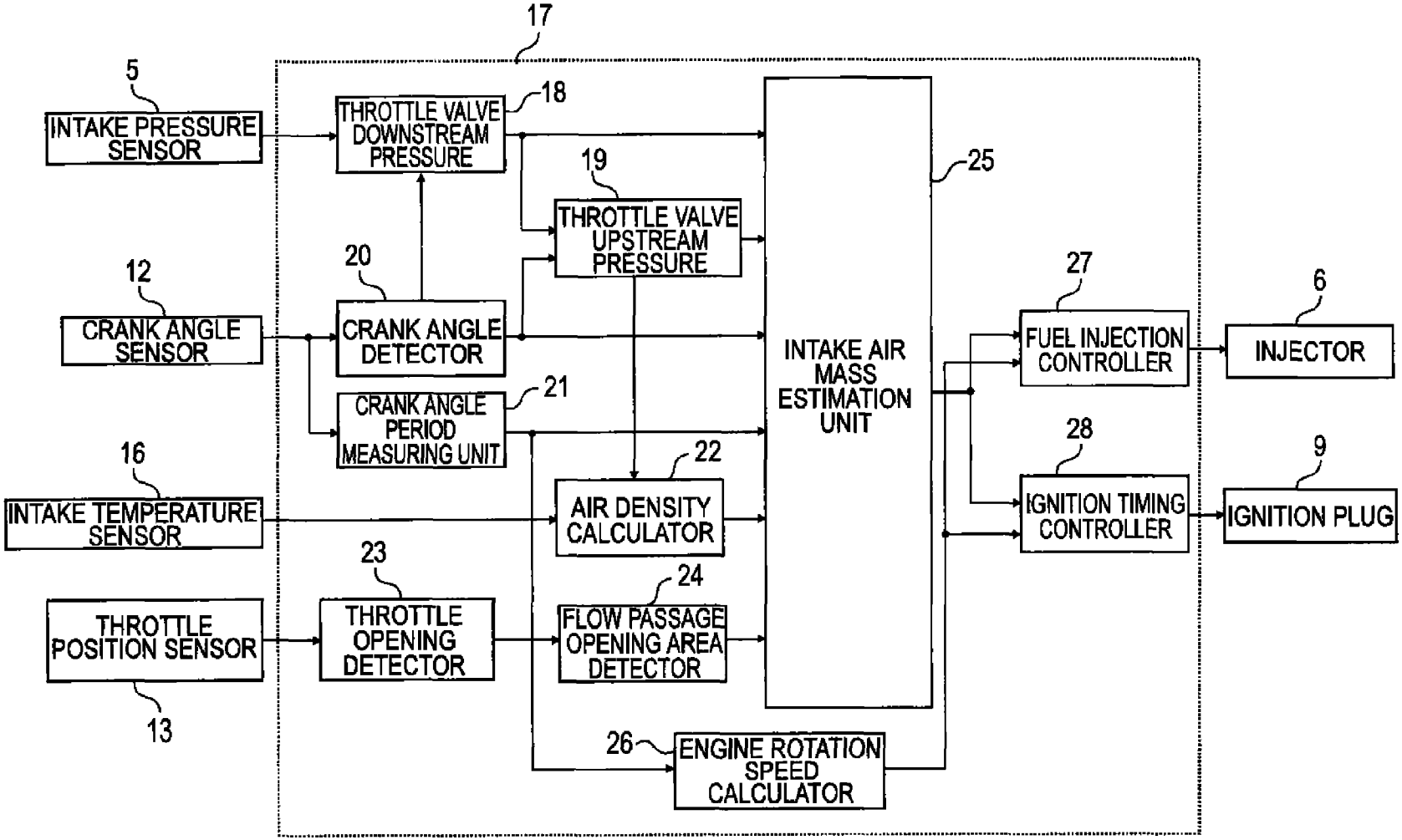
FIG. 2 is a block diagram showing the functional configuration of the intake air mass estimation apparatus for motorcycle in accordance with the first embodiment of the invention.

FIG. 2 is a block diagram showing the functional configuration of the intake air mass estimation apparatus for motorcycle in accordance with the first embodiment.

The control unit 17 includes a throttle valve downstream pressure detector 18, a throttle valve upstream pressure detector 19, a crank angle detector 20, a crank angle period measuring unit 21, an air density calculator 22, a throttle opening detector 23, a flow passage opening area detector 24, an intake air mass estimation unit 25, an engine rotation speed calculator 26, a fuel injection controller 27 and an ignition timing controller 28.

The intake pressure sensor 5 detects the internal pressure of the intake pipe 3 of the throttle valve downstream 4*b*. The detected internal pressure of the intake pipe 3 is input to the throttle valve downstream pressure detector 18. The crank angle sensor 12 is a sensor that can detect that the crankshaft has performed predetermined degrees of crank angle rotation (e.g., 15 degrees of crank angle) from the reference position (e.g., exhaust top dead center) of the crankshaft. Note that predetermined degrees of crank angle needs to be determined taking into consideration the throttle downstream pressure fluctuation in the intake stroke, the engine rotation speed in the compression and combustion strokes and the microcomputer processing load.

The crank angle detector 20 captures the signal from the crank angle sensor 12 to detect the rotated angle of the crankshaft from the reference position. The crank angle period measuring unit 21 uses the signal from the crank angle sensor 12 to determine the time taken for predetermined degrees of crank angle rotation. The intake temperature sensor 16 measures the temperature of the air mass passing through the throttle valve 4. The measured temperature is input to the air density calculator 22. The throttle position sensor 13 detects the rotated angle of the throttle valve 4. The detected rotated angle is input to the throttle opening detector 23. The throttle valve downstream pressure detector 18 determines the throttle valve downstream pressure in response to the signal from the intake pressure sensor 5 each time of being informed by the crank angle detector 20 that predetermined degrees of crank angle rotation has been performed. The throttle valve upstream pressure detector 19 estimates the throttle valve upstream pressure from the throttle valve downstream pressure during the period in which the intake valve 8 is closed, based on information from the crank angle detector 20 and the throttle valve downstream pressure detector 18.

Figure 3A:
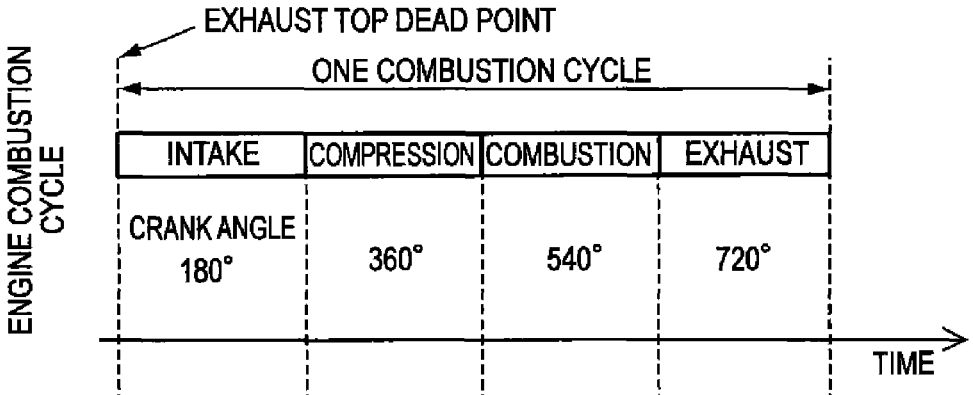
FIGS. 3A and 3B are explanatory diagrams showing an engine combustion cycle and the throttle valve downstream pressure, respectively, when the downstream pressure just before intake valve opening has converged to a certain value for the intake air mass estimation apparatus for motorcycle in accordance with the first embodiment of the invention.
Figure 3B:
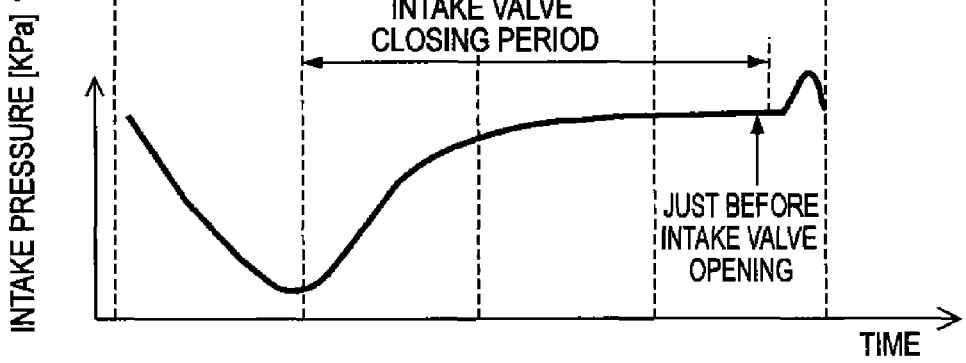
Figure 4A:
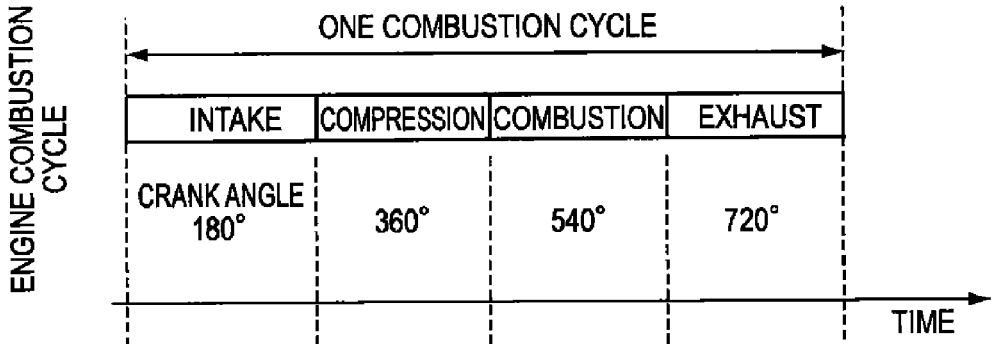
FIGS. 4A and 4B are explanatory diagrams showing the engine combustion cycle and the throttle valve downstream pressure, respectively, when the downstream pressure just before intake valve opening has not converged to a certain value for the intake air mass estimation apparatus for motorcycle in accordance with the first embodiment of the invention.
Figure 4B:
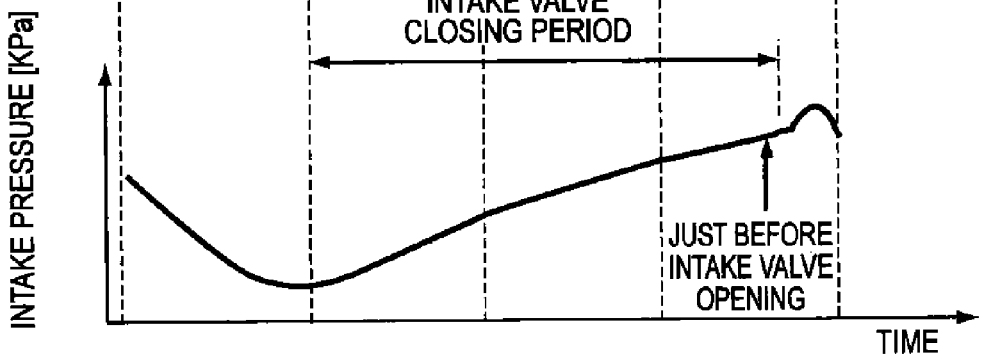

Here, a method for obtaining the throttle valve upstream pressure is described with reference to FIGS. 3A, 3B, 4A, and 4B. FIGS. 3A and 3B show the throttle valve downstream pressure when the downstream pressure just before intake valve opening has converged to a certain value. FIGS. 4A and 4B show the throttle valve downstream pressure when the downstream pressure just before intake valve opening has not converged to a certain value. Note that FIGS. 3A and 4A show the engine combustion cycle with the time indicated by the horizontal axis. In FIGS. 3B and 4B, the horizontal axis indicates the time and the vertical axis indicates the intake pressure.

When the throttle valve downstream pressure (intake pressure) just before intake valve opening has converged to a certain value, as shown in FIG. 3B, the throttle valve downstream pressure has become equal to the throttle valve upstream pressure. Accordingly, the throttle valve downstream pressure just before intake valve opening can be considered equal to the throttle valve upstream pressure. On the other hand, when the throttle valve 4 is open only slightly or when the engine rotation speed is high, the throttle valve downstream pressure just before intake valve opening has not converged to a certain value, as shown in FIG. 4B. So, the throttle valve downstream pressure just before intake valve opening cannot be considered equal to the throttle valve upstream pressure.

Thus, a method for estimating the throttle valve upstream pressure from the throttle valve downstream pressure during the period in which the intake valve 8 is closed is discussed. The throttle valve upstream pressure is determined by the throttle valve downstream pressure just before intake valve opening, the throttle valve downstream pressure when the valve is closed, the air mass passing through the throttle valve 4 and the time from the closing to the opening of the intake valve 8. The air mass passing through the throttle valve 4 is determined by the throttle valve upstream pressure, the throttle valve downstream pressure and the flow passage opening area. Therefore, the throttle valve upstream pressure can be calculated by capturing a change in the throttle valve downstream pressure during the intake valve closing period.

In another method for estimating the throttle valve upstream pressure, assuming that the throttle valve upstream pressure and the throttle valve downstream pressure just before intake valve opening become in a certain relation in each operating range, a coefficient for converting the throttle valve downstream pressure just before intake valve opening to the throttle valve upstream pressure may be determined by map data of the engine load and the engine rotation speed. As the engine load, one of the throttle opening, the throttle valve downstream pressure or the air mass passing through the throttle valve 4 determined by assuming the throttle valve downstream pressure just before intake valve opening as a tentative throttle valve upstream pressure may be used.

In the above, the use of the intake pressure just before intake valve opening for the throttle valve upstream pressure estimation has been discussed. However, when the intake pressure sensor 5 vibrates or pulsates, a maximum value of the throttle valve downstream pressure during the intake valve closing period may be used or an average value of the throttle valve downstream pressure of a plurality of data within the intake valve closing period may be used.

Returning to FIG. 2, the air density calculator 22 determines the air density using the throttle valve upstream pressure and the intake temperature. The air density can be calculated by the equation: $\rho = P1/(R \times T)$, where $\rho$ is the air density, P1 is the throttle valve upstream pressure, T is the intake temperature and R is the gas constant. The throttle opening detector 23 calculates the throttle opening from the signal from the throttle position sensor 13. Information on the calculated throttle opening is input to the flow passage opening area detector 24. The flow passage opening area detector 24 calculates the opening area of the throttle valve 4 corresponding to the throttle opening. Note that the flow passage opening area in the embodiment is the throttle valve opening area, however, the flow passage opening area for a vehicle in which a bypass air passage is provided for idle speed control and the like is the throttle valve opening area added with the bypass air passage opening area.

The intake air mass estimation unit 25 calculates the intake air mass estimation using the throttle valve downstream pressure determined by the throttle valve downstream pressure detector 18, the throttle valve upstream pressure determined by the throttle valve upstream pressure detector 19, the crank angle determined by the crank angle detector 20, the crank angle period determined by the crank angle period measuring unit 21, the air density $\rho$ determined by the air density calculator 22 and the flow passage opening area determined by the flow passage opening area detector 24. The air mass used for one combustion estimated by the intake air mass estimation unit 25 is input to the fuel injection controller 27 and the ignition timing controller 28.

The engine rotation speed calculator 26 calculates the engine rotation speed using the crank angle period determined by the crank angle period measuring unit 21. The fuel injection controller 27 determines the fuel injection amount using the intake air mass estimation determined by the intake air mass estimation unit 25 and the engine rotation speed determined by the engine rotation speed calculator 26, then calculates various compensations not shown, and then causes the injector 6 to inject fuel. The ignition timing controller 28 determines the ignition timing using the intake air mass estimation determined by the intake air mass estimation unit 25 and the engine rotation speed determined by the engine rotation speed calculator 26, then calculates various compensations not shown, and then causes the ignition plug 9 to perform ignition.

Figure 5:
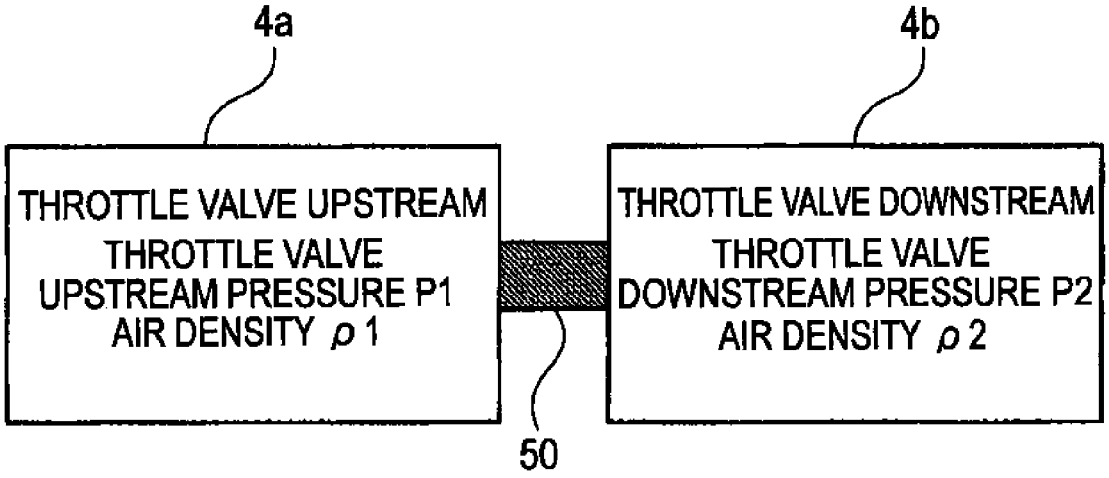
FIG. 5 is a diagram showing an intake model for the intake air mass estimation apparatus for motorcycle in accordance with the first embodiment of the invention.

Next, a method for calculating the throttle model intake air mass estimation is described with reference to FIG. 5. In FIG. 5, the throttle valve upstream 4*a* is configured with the throttle valve upstream pressure P1 and the air density $\rho$1. A throttle valve opening 50 is configured with a flow passage opening area A. An intake air passing through the throttle valve opening 50 is pressurized by the throttle valve upstream pressure P1 and the throttle valve downstream pressure P2. The throttle valve downstream 4*b* is configured with the throttle valve downstream pressure P2 and the air density $\rho$2. Note that the air density $\rho$1 is considered constant across the whole area. The throttle passing flow rate in the intake air mass estimation model in FIG. 5 is estimated from the following equation (1) based on a fluid mechanics equation.

$$m = A \times \sqrt{\rho 1 \times P1} \sqrt{\frac{2\kappa}{\kappa - 1} \times \left\{ \left(\frac{P2}{P1}\right)^{\frac{2}{\kappa}} - \left(\frac{P2}{P1}\right)^{\frac{\kappa+1}{\kappa}} \right\}} \quad (1)$$

Where m is the mass flow rate of gas passing through the throttle valve 4, A is the flow passage opening area, P1 is the throttle valve upstream pressure, P2 is the throttle valve downstream pressure, $\rho$1 is the upstream air density, R is the gas constant and $\kappa$ is the ratio of specific heat of intake air.

In the equation (1), P2/P1 less than or equal to 0.528 causes a critical state, and the flow rate with P2/P1 equal to 0.528 causes choking. At this time, the speed of the intake air passing through the throttle becomes equal to the sound speed.

On the other hand, when the throttle valve upstream pressure is lower than the throttle valve downstream pressure, the throttle passing flow rate is estimated from the following equation (2).

$$m = A \times \sqrt{\rho 2 \times P2} \sqrt{\frac{2\kappa}{\kappa - 1} \times \left\{ \left(\frac{P1}{P2}\right)^{\frac{2}{\kappa}} - \left(\frac{P1}{P2}\right)^{\frac{\kappa+1}{\kappa}} \right\}} \quad (2)$$

Where m is the mass flow rate of gas passing through the throttle valve 4, A is the flow passage opening area, P1 is the throttle valve upstream pressure, P2 is the throttle valve downstream pressure, $\rho$2 is the downstream air density, R is the gas constant and $\kappa$ is the ratio of specific heat of intake air.

Here, a method for estimating the air mass used for one combustion is described with reference to FIGS. 6A, 6B, 6C, and 6D. Note that the horizontal axis of FIGS. 6A, 6B, 6C, and 6D indicates the time; the vertical axis of FIG. 6A indicates the engine combustion cycle from the reference position (exhaust top dead center); the vertical axis of FIG. 6B indicates the intake pressure; the vertical axis of FIG. 6C indicates the instantaneous engine rotation speed; and the vertical axis of FIG. 6D indicates the mass flow rate of gas passing through the throttle valve 4.

Figure 6A:
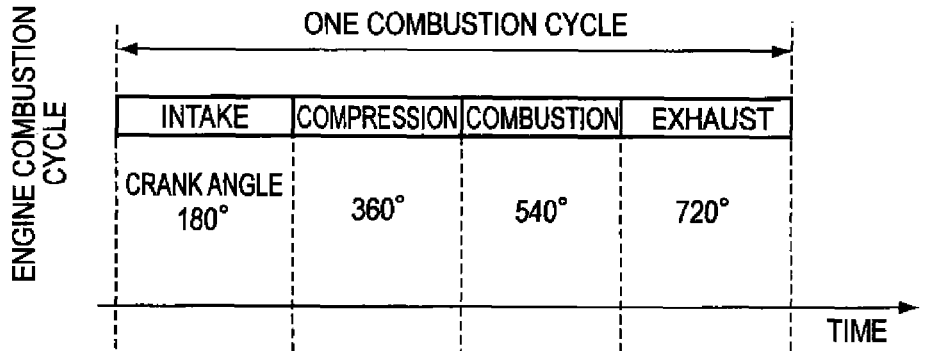
FIGS. 6A, 6B, 6C, and 6D are explanatory diagrams showing the engine combustion cycle, the throttle valve downstream pressure (intake pressure), the engine rotation speed, and the mass flow rate of gas passing through the throttle valve, respectively, when the engine rotation fluctuation is small for the intake air mass estimation apparatus for motorcycle in accordance with the first embodiment of the invention.
Figure 6B:
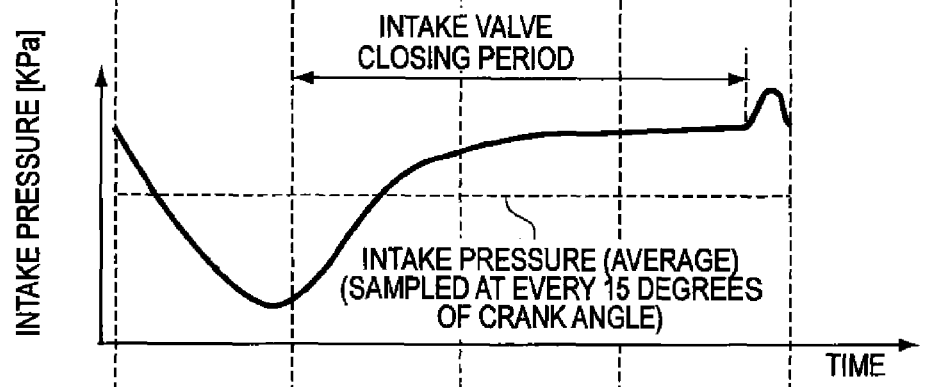
Figure 6C:
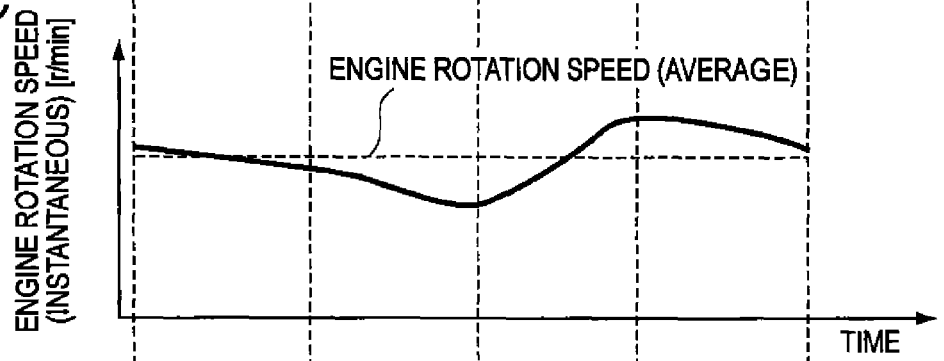

As shown in FIG. 6A, the crank angle from the reference position tells the progress of the combustion cycle of the engine 1 (intake stroke, compression stroke, combustion stroke, exhaust stroke). In the intake stroke, as shown in FIG. 6B, air is taken into the cylinder 2, so the pressure on the throttle valve downstream 4*b* side decreases. Further, as shown in FIG. 6C, a pumping loss when air is taken into the cylinder 2 causes the instantaneous engine rotation speed to decrease. In the compression stroke, as shown in FIG. 6B, the pressure on the throttle valve downstream 4*b* side increases toward the throttle valve upstream pressure until the intake valve 8 opens. Further, as shown in FIG. 6C, the instantaneous engine rotation speed decreases also when the piston 7 compresses air. In the combustion stroke, as shown in FIG. 6C, expansion of combustion gas caused by combustion pushes down the piston 7, causing the instantaneous engine rotation speed to increase.

Figure 6D:
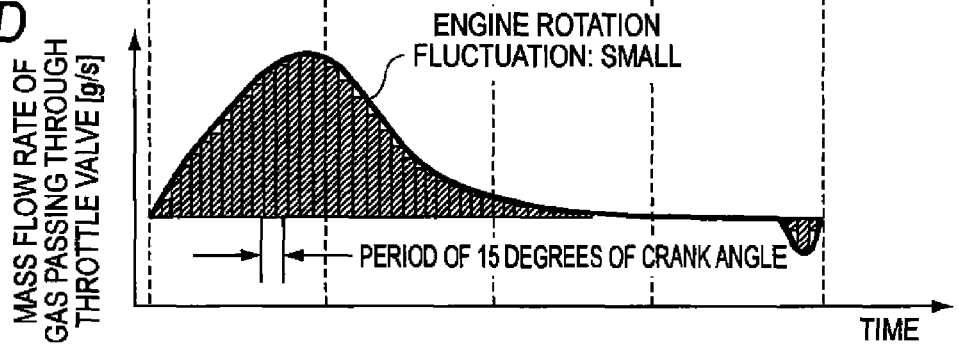

In the exhaust stroke, as shown in FIG. 6C, a pumping loss when combustion gas is exhausted from the cylinder 2 causes the instantaneous engine rotation speed to decrease. Throughout this combustion cycle, the mass flow rate of gas passing through the throttle valve 4 varies as shown in FIG. 6D. Therefore, the estimation of the air mass used for one combustion is calculated according to the following equation (3) by calculating the mass flow rate of gas passing through the throttle valve 4 determined by the equation (1) at every 15 degrees of crank angle and integrating the calculated mass flow rate for 720 degrees of crank angle using the period of 15 degrees of crank angle rotation. Then, the estimation is represented by the area of a shaded portion shown in FIG. 6D.

$$Q=\Sigma_{n=0}^{47}\{m(n)\times t15(n)\} \quad (3)$$

Where Q is the air mass used for one combustion, and t15 is the period of 15 degrees of crank angle rotation.

Note that, when the throttle valve downstream pressure is higher than the throttle valve upstream pressure, the equation (2) is used to determine the mass flow rate of gas passing through the throttle valve 4, and the determined value is made negative to perform calculation of the equation (3).

Next, the estimation of the air mass used for one combustion when the engine rotation fluctuation is large due to large engine load, difference in combustion conditions and the like is described with reference to FIGS. 7A, 7B, 7C, and 7D and compared with the case when the engine rotation fluctuation is small. Note that the horizontal axis of FIGS. 7A, 7B, 7C, and 7D indicates the time; the vertical axis of FIG. 7A indicates the engine combustion cycle from the reference position (exhaust top dead center); the vertical axis of FIG. 7B indicates the intake pressure; the vertical axis of FIG. 7C indicates the instantaneous engine rotation speed; and the vertical axis of FIG. 7D indicates the mass flow rate of gas passing through the throttle valve 4.

Figure 7A:
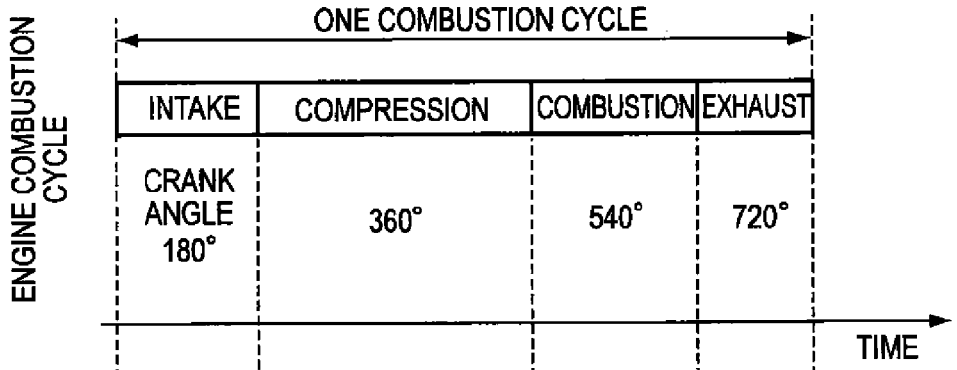
FIGS. 7A, 7B, 7C, and 7D are explanatory diagrams showing the engine combustion cycle, the throttle valve downstream pressure (intake pressure), the engine rotation speed and the mass flow rate of gas passing through the throttle valve, respectively, when the engine rotation fluctuation is large for the intake air mass estimation apparatus for motorcycle in accordance with the first embodiment of the invention.
Figure 7B:
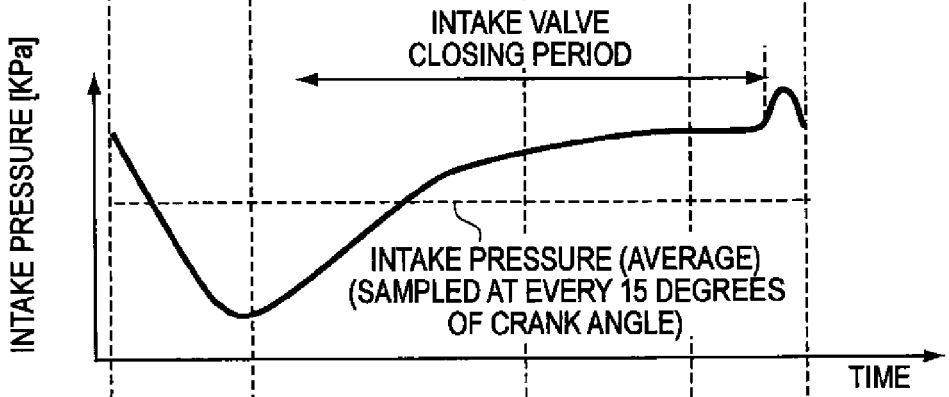
Figure 7C:
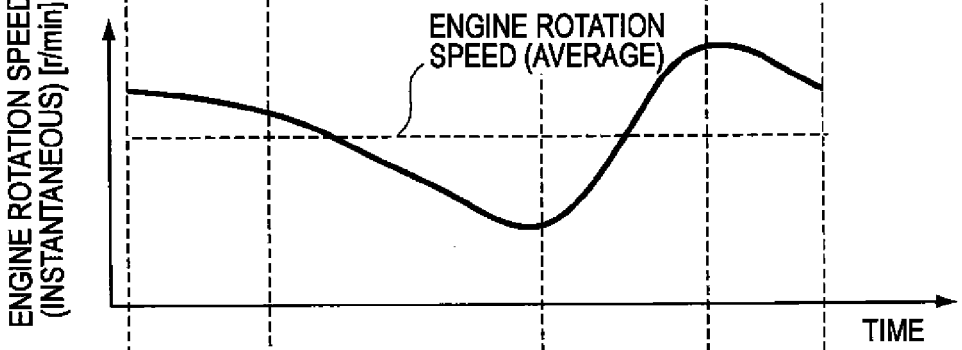
Figure 7D:
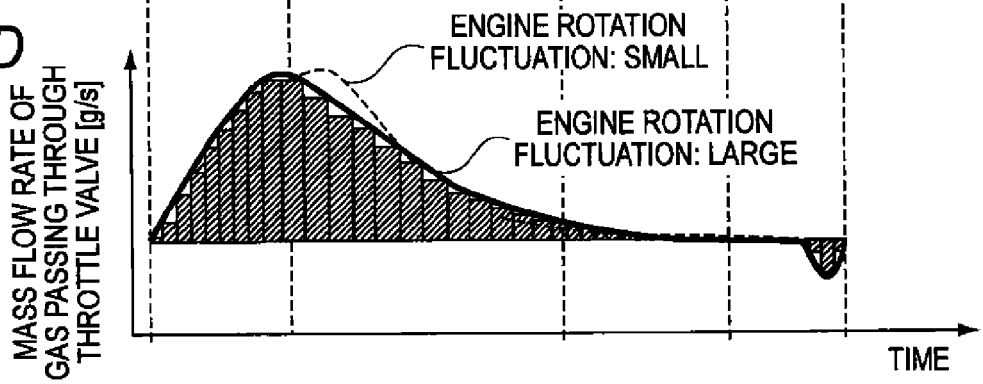

As shown in FIG. 7C, assume that the engine rotation fluctuation is large due to large load of the engine 1. However, assume that the average engine rotation speed is the same as that of FIG. 6C. Assume that, for the pressure (intake pressure) in the throttle valve downstream 4*b*, the pressure at each crank angle is equal to that of FIG. 6C, as shown in FIG. 7B. Also, assume that the flow passage opening area of the throttle valve 4 is equal to that of FIG. 6D. The estimation of the air mass used for one combustion in this case is represented by the area of a shaded portion shown in FIG. 7D. As seen from the estimation, the air mass used for one combustion increases with respect to the case with the small engine rotation fluctuation as shown in FIGS. 6A, 6B, 6C and 6D. Variation in the mixture ratio of air and fuel by 5-7% or so has a significant impact on the emission amount of substance of concern and the drive feeling, so the intake air mass estimation needs to be performed taking into consideration the engine rotation fluctuation.

Note that, in this embodiment, the engine rotation fluctuation is discussed for a single cylinder engine, however, the engine rotation fluctuation may also become large for a multi-cylinder engine. For example, for a twin-cylinder engine, having a separate electronic throttle valve for each cylinder, when the opening of one throttle is different from the opening of the other throttle, one cylinder may generate a large torque, while the other cylinder may generate a small torque. As a result, the engine rotation fluctuation may become large. As another example, for a multi-cylinder engine, when combustion is performed at unequal intervals during 720 degrees of crank angle, the engine rotation fluctuation may become large. Also for a multi-cylinder engine, the throttle valve downstream pressure fluctuation may become large. For example, when a throttle valve and a intake pressure sensor are provided for each cylinder, the throttle valve downstream pressure fluctuation detected by each individual intake pressure sensor may become large. Thus, for some engine characteristics, the invention may be applicable to a multi-cylinder engine.

Figure 8:
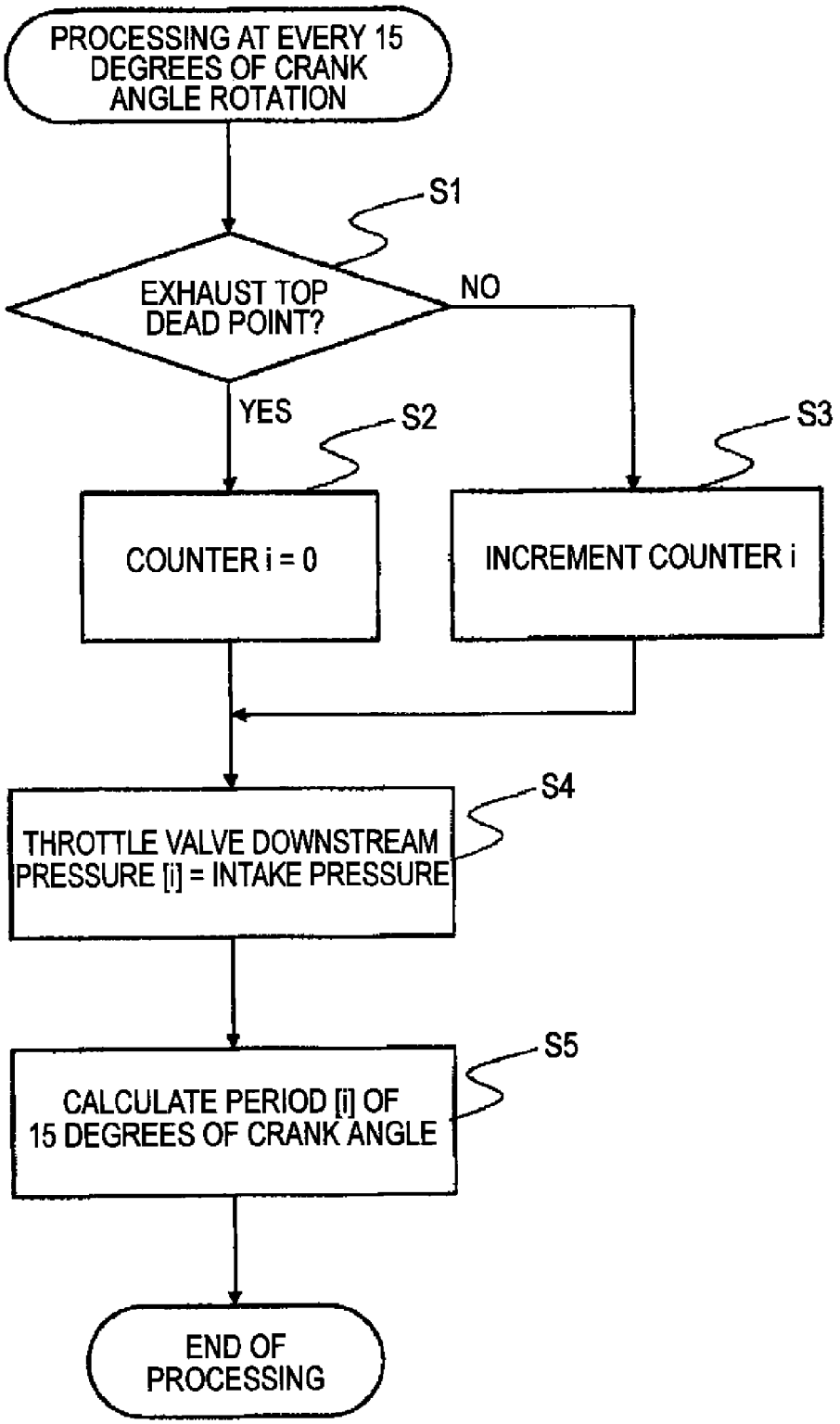
FIG. 8 is a flowchart of the processing at every 15 degrees of crank angle rotation for the intake air mass estimation for the intake air mass estimation apparatus for motorcycle in accordance with the first embodiment of the invention.

Next, an example of the throttle model intake air mass estimation method performed by the intake air mass estimation unit 25 is described with reference to the flowcharts of FIGS. 8, 9 and 10. The calculation processing of the throttle model intake air mass estimation is divided into the processing at every predetermined degrees of crank angle (e.g., at every 15 degrees of crank angle rotation) and the processing at every predetermined control period (e.g., 5 ms) to reduce processing load.

The processing at every predetermined degrees of crank angle includes capturing the intake pressure data and the time taken for predetermined degrees of crank angle rotation and storing 720 degrees of the captured data. On the other hand, the processing at every predetermined period includes calculating the intake air mass passing through the throttle valve 4 using the stored intake pressure data and time taken for predetermined degrees of crank angle rotation. What is considered from this is that, at a low engine rotation speed having a large impact on exhaust gas regulation and fuel efficiency, the calculation of the intake air mass estimation is performed with a sufficiently short period (for example, at 2400 r/min, 720 degrees of period is 50 ms) to improve the fuel injection accuracy, and at a high engine rotation speed with a high microcomputer calculation load, the throttle model intake air mass estimation is introduced to suppress increase in microcomputer load. The processing of FIG. 8 is performed at every 15 degrees of crank angle rotation.

First, in step S1, it is determined whether or not the current round of processing is at the exhaust top dead center. The reference position of the crankshaft may be detected by a reference position detection sensor attached to the camshaft or configuring the crank angle sensor so that its output signal changes at 45 degrees of crank angle rotation only in some sections and capturing the change.

If determined in the step S1 that the processing is at the exhaust top dead center, a counter i is set to 0 in step S2, then the process proceeds to step S4. On the other hand, if determined in the step S1 that the processing is not at the exhaust top dead center, the counter i is incremented in step S3, then the process proceeds to the step S4.

In the step S4, the intake pressure value obtained from the intake pressure sensor 5 is stored into a throttle valve downstream pressure [i] specified by i among an array of data including a throttle valve downstream pressure [0] to a throttle valve downstream pressure [47]. Next, in step S5, the time that has elapsed since the previous processing at 15 degrees of crank angle rotation until the current processing at 15 degrees of crank angle rotation is measured, then the measured data is stored into a period [i] of 15 degrees of crank angle rotation specified by i among an array of data including a period [0] of 15 degrees of crank angle rotation to a period [47] of 15 degrees of crank angle rotation.

Figure 9:
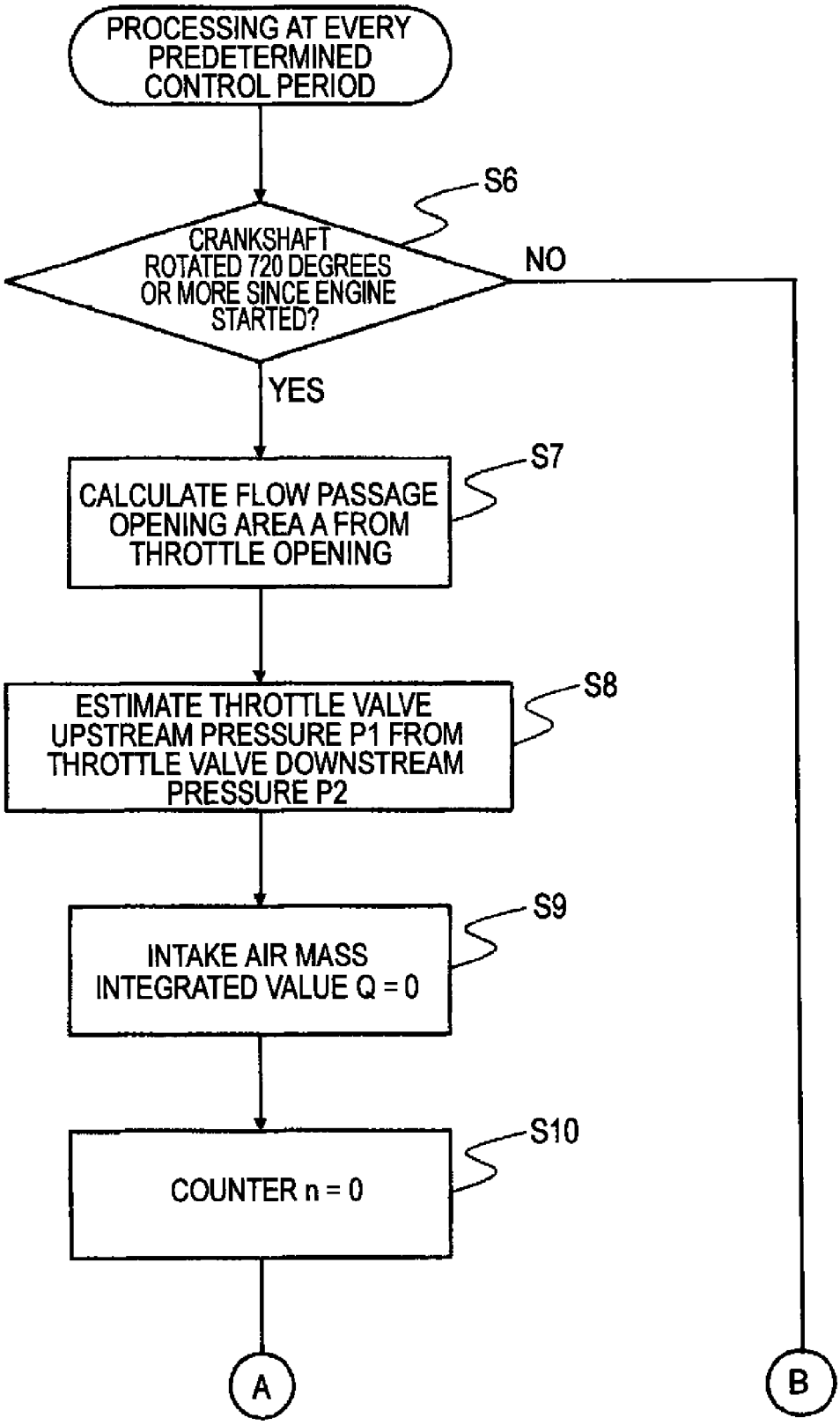
FIG. 9 is a flowchart of the processing at every predetermined control period for the intake air mass estimation for the intake air mass estimation apparatus for motorcycle in accordance with the first embodiment of the invention.
Figure 10:
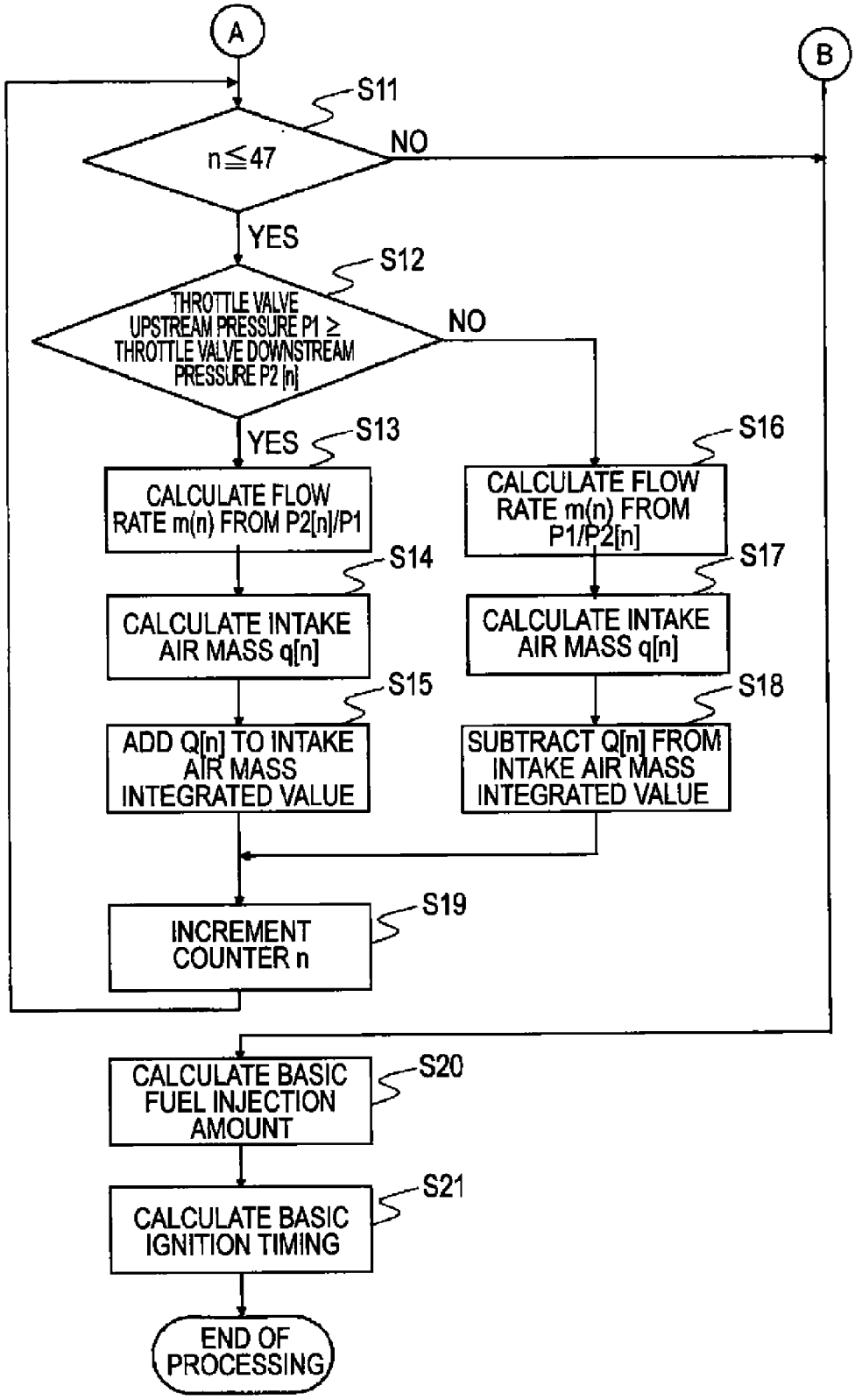
FIG. 10 is a flowchart of the processing at every predetermined control period for the intake air mass estimation for the intake air mass estimation apparatus for motorcycle in accordance with the first embodiment of the invention.

The processing of FIGS. 9 and 10 is performed at every predetermined control period (e.g., 5 ms), in which the processing of the intake air mass estimation is performed using the throttle valve downstream pressure and the period of 15 degrees of crank angle rotation obtained in the processing at every 15 degrees of crank angle rotation.

In step S6, it is determined whether or not the crankshaft has rotated 720 degrees or more since the engine started. If determined that the crankshaft has rotated 720 degrees or more, the data of the throttle valve downstream pressure and the period of 15 degrees of crank angle rotation that are necessary for the intake air mass estimation has been stored, so the processing of the intake air mass estimation from step S7 will be performed. If determined that the crankshaft has not rotated 720 degrees or more since the engine started, the process ends.

In the step S7, the flow passage opening area A is calculated from the throttle opening. Assume that the relationship between the throttle opening and the flow passage opening area A is prepared as map data. Here, the throttle opening is determined according to the throttle position sensor 13, however, the throttle opening may also be estimated from map data of the average of all or some sections of the throttle valve downstream pressure and the engine rotation speed during 720 degrees of crank angle rotation. In this case, the determined average of the throttle valve downstream pressure needs to be compensated with the atmospheric pressure and the intake temperature.

Next, in step S8, the throttle valve upstream pressure P1 is estimated from the throttle valve downstream pressure P2. For example, it is estimated by multiplying the throttle valve downstream pressure P2 by a coefficient that converts the throttle valve downstream pressure P2 just before intake valve opening stored through the processing at every 15 degrees of crank angle rotation into the throttle valve upstream pressure P1. Assume that the coefficient that converts the throttle valve downstream pressure P2 just before intake valve opening into the throttle valve upstream pressure P1 is prepared as map data with the throttle opening and engine rotation speed as input.

Next, in step S9, the intake air mass integrated value Q is set to 0.

Next, in step S10, the counter n is set to 0.

Next, in step S11, it is determined whether or not the counter n is equal to or less than 47. This determination of whether or not the counter is equal to or less than 47 is intended to calculate the intake air mass for 720 degrees of crank angle rotation by repeating the processing from the step S12 48 times. If determined that the counter n is equal to or less than 47, the process proceeds to step S12. If determined that the counter n is larger than 47, the process proceeds to step S20.

Next, in the step S12, the throttle valve upstream pressure P1 is compared to the throttle valve downstream pressure P2. If the throttle valve upstream pressure P1 is larger, the process proceeds to step S13. If the throttle valve upstream pressure P1 is smaller, the process proceeds to step S16.

In the step S13, the flow rate m(n) is calculated using the equation (1) from "throttle valve downstream pressure P2(*n*)/throttle valve upstream pressure P1." Here, in order to reduce calculation processing load, in calculating the equation (1), part of the equation (1) may also be extracted as shown in the following equation (4) to prepare map data with P2/P1 as input.

$$K = \sqrt{\frac{2\kappa}{\kappa - 1} \times \left\{ \left(\frac{P2}{P1}\right)^{\frac{2}{K}} - \left(\frac{P2}{P1}\right)^{\frac{K+1}{K}} \right\}} \tag{4}$$

The air density is determined from the intake temperature and the throttle valve upstream pressure P1 and is used in the equation (1). Another possible example of taking the air density into consideration is that, after the equation (1) is calculated using the air density under standard condition (the throttle valve upstream pressure P1=101.3 [kPa], the intake temperature: 25[° C.]), the air mass Q or fuel injection amount used for one combustion determined under standard condition is compensated with the ratio of the air density calculated from the intake temperature and the throttle valve upstream pressure P1 to the air density under standard condition. This provides an effect of facilitating the replacement of the above-described conventional intake air mass estimation method, such as the throttle speed method or speed density method, by the throttle model intake air mass estimation method of the invention.

In step S14, the air mass q(n) passing through the throttle valve 4 during 15 degrees of crank angle rotation is calculated from the flow rate m(n) determined above, as shown in the following equation (5).

$$q(n)=m(n)\lambda t15(n) \tag{5}$$

In step S15, the air mass q(n) passing through the throttle valve 4 during 15 degrees of crank angle rotation determined above is added to the intake air mass integrated value Q(n), as shown in the equation (6).

$$Q(n)=Q(n-1)+q(n) \tag{6}$$

Where Q(n−1) is the intake air mass integrated value calculated in the previous round, and Q(n) is the intake air mass integrated value calculated in the current round.

On the other hand, if determined in the step S12 that the throttle valve downstream pressure P2(*n*) is higher than the throttle valve upstream pressure P1, in the step S16, the flow rate m(n) is calculated using the equation (2) from "throttle valve upstream pressure P1/throttle valve downstream pressure P2(*n*)." Here, in order to reduce calculation processing load, in calculating the equation (2), part of the equation (2) may also be extracted as shown in the following equation (7) to prepare map data with P1/P2 as input.

$$K = \sqrt{\frac{2\kappa}{\kappa - 1} \times \left\{ \left(\frac{P1}{P2}\right)^{\frac{2}{K}} - \left(\frac{P1}{P2}\right)^{\frac{K+1}{K}} \right\}} \tag{7}$$

In step S17, the air mass q(n) passing through the throttle valve 4 during 15 degrees of crank angle rotation is calculated from the flow rate m(n) determined above, as shown in the equation (5).

In step S18, the air mass q(n) passing through the throttle valve 4 during 15 degrees of crank angle rotation determined above is subtracted from the intake air mass integrated value Q(n), as shown in the following equation (8).

$$Q(n)=Q(n-1)-q(n) \tag{8}$$

In step S19, the counter n is incremented, and the process returns to the step S11. After the step S11 through the step S19 is repeated 48 times, the intake air mass integrated value Q(n) reaches the air mass used for one combustion.

In step S20, the basic fuel injection amount is calculated from a three-dimensional map of the air mass Q used for one combustion and the engine rotation speed, then various compensations are calculated, and then the calculated injection amount of fuel is injected by the injector 6.

In step S21, the basic ignition timing is calculated from a three-dimensional map of the air mass Q used for one combustion and the engine rotation speed, then various compensations are calculated, and then the ignition is performed by the ignition plug according to the calculated ignition timing.

As described above, the intake air mass estimation apparatus for motorcycle in accordance with the first embodiment includes: the throttle valve 4 for controlling the air mass taken into the engine 1; the throttle valve upstream pressure detector 19 for detecting the pressure upstream of the throttle valve 4; the throttle valve downstream pressure detector 18 for detecting the pressure downstream of the throttle valve 4; the flow passage opening area detector 24 for detecting an entire flow passage area between the upstream side of the throttle valve 4 and the downstream side of the throttle valve 4; the crank angle detector 20 for detecting a rotated angle from the reference position of the crankshaft 11 of the engine 1; the crank angle period measuring unit 21 for measuring the time taken for predetermined degrees of crank angle rotation; and the intake air mass estimation unit 25 for viewing the throttle valve 4 as an orifice to estimate the intake air mass estimation value based on the pressure upstream of the throttle valve 4, the pressure downstream of the throttle valve 4 and the flow passage opening area A detected by the flow passage opening area detector 24, wherein the intake air mass estimation unit 25 sets the predetermined degrees of crank angle to an angle that can divide the intake stroke into a plurality of sections, measures at every the predetermined degrees of crank angle at least the pressure downstream of the throttle valve 4 and the time taken for the predetermined degrees of crank angle rotation, estimates the intake air mass flowing from the upstream of the throttle valve 4 to the downstream of the throttle valve 4 at every the predetermined degrees of crank angle, using the pressure downstream of the throttle valve 4 and the time taken for the predetermined degrees of crank angle rotation measured at every the predetermined degrees of crank angle, and integrates the intake air mass at every the predetermined degrees of crank angle for 720 degrees of crank angle rotation, thereby estimating the intake air mass needed for one combustion, so, for a single-cylinder engine, even when the pressure fluctuation downstream of the throttle valve 4 is large and the engine rotation fluctuation is large, the intake air mass needed for one combustion can be accurately estimated.

Furthermore, in estimating the intake air mass passing through the throttle valve 4 at every predetermined degrees of crank angle, when the pressure downstream the throttle valve 4 is higher than the pressure upstream of the throttle valve 4, air is considered to be flowing back from the downstream of the throttle valve 4 to the upstream of the throttle valve 4, then the intake air mass is calculated with the relationship between the pressure upstream the throttle valve 4 and the pressure downstream of the throttle valve 4 reversed, and, in integrating the intake air mass determined at every predetermined degrees of crank angle, the integration is performed with the intake air mass of the section in which air is considered to be flowing back made negative, so, even when air is blowing back from the downstream of the throttle valve 4 to the upstream of the throttle valve 4 with the intake valve opened, the intake air mass needed for one combustion can be accurately estimated.

Furthermore, the throttle valve upstream pressure detector 19 estimates the pressure upstream of the throttle valve 4 using the pressure downstream of the throttle valve 4 during the intake valve closing period from when the intake valve 8 of the cylinder 2 closes till when the intake valve 8 opens next time, so, without an additional sensor for detecting the pressure upstream of the throttle valve 4, the pressure upstream of the throttle valve 4 that varies under the influence of pressure loss due to an air cleaner or supercharging due to traveling wind pressure (ram pressure) or the like can be captured at every 720 degrees of crank angle rotation.

Furthermore, when it is determined that the pressure downstream of the throttle valve 4 has converged to a certain value, the converged value is considered as the pressure upstream of the throttle valve 4, and when it is determined that the pressure downstream of the throttle valve 4 is increasing toward the pressure upstream of the throttle valve 4, the pressure upstream of the throttle valve 4 is estimated from the pressure downstream of the throttle valve 4 just before the intake valve 8 opens or the maximum value of the pressure downstream the throttle valve 4 during the intake valve closing period, so, even when the flow passage opening area A of the throttle valve 4 is small and the pressure downstream of the throttle valve 4 does not converge to the pressure upstream of the throttle valve 4 in the intake valve closing period, a change in the pressure upstream of the throttle valve 4 can be captured at every 720 degrees of crank angle rotation from the pressure downstream of the throttle valve 4.

Furthermore, when it is determined that the pressure downstream of the throttle valve 4 has converged to a certain value, the converged value is considered as the pressure upstream of the throttle valve 4, and when it is determined that the pressure downstream of the throttle valve 4 is increasing toward the pressure upstream of the throttle valve 4, the pressure upstream of the throttle valve 4 is estimated from an amount of change in the pressure downstream of the throttle valve 4 per predetermined period, so, even when the flow passage opening area A of the throttle valve 4 is small and the pressure downstream of the throttle valve 4 does not converge to the pressure upstream of the throttle valve 4 in the intake valve closing period, a change in the pressure upstream of the throttle valve 4 can be captured at every 720 degrees of crank angle rotation from the pressure downstream of the throttle valve 4.

Furthermore, the air density calculator 22 for calculating the air density of the intake air mass is provided, and the air density is calculated using the pressure upstream of the throttle valve 4 estimated above as the pressure of intake air, so, without an additional sensor for detecting the pressure upstream of the throttle valve 4, the air density that varies under the influence of pressure loss due to an air cleaner or supercharging due to traveling wind pressure (ram pressure) or the like can be captured at every 720 degrees of crank angle rotation.

Furthermore, the flow passage opening area A of the throttle valve 4 is set based on the throttle opening, so the flow passage opening area A of the throttle valve 4 can be calculated from the throttle opening determined through the throttle position sensor 13 for detecting the operation of the throttle valve 4.

Furthermore, the throttle opening is estimated using characteristics data preset based on information on the pressure downstream of the throttle valve 4 and the engine rotation speed, so the flow passage opening area A of the throttle valve 4 can be calculated without the throttle position sensor 13 for detecting the operation of the throttle valve 4.

One embodiment of the invention has been described, however, the invention is not limited to this, and these configurations may be appropriately combined, may be partially changed or may be partially omitted without departing from the spirit of the invention.

Various modifications and alterations of this invention will be apparent to those skilled in the art without departing from the scope and spirit of this invention, and it should be understood that this is not limited to the illustrative embodiments set forth herein.

What is claimed is:

1. An intake air mass estimation apparatus for motorcycle comprising:

a throttle valve for controlling the air mass taken into a four-stroke engine;

a throttle valve upstream pressure detector for detecting the pressure upstream of the throttle valve;

a throttle valve downstream pressure detector for detecting the pressure downstream of the throttle valve;

a flow passage opening area detector for detecting an entire flow passage area between the upstream side of the throttle valve and the downstream side of the throttle valve;

a crank angle detector for detecting a rotated angle from a reference position of a crankshaft of the four-stroke engine;

a crank angle period measuring unit for measuring the time taken for predetermined degrees of crank angle rotation; and an intake air mass estimation unit for viewing the throttle valve as an orifice to estimate the intake air mass estimation value based on the pressure upstream of the throttle valve, the pressure downstream of the throttle valve and the flow passage opening area detected by the flow passage opening area detector, wherein the intake air mass estimation unit:

sets the predetermined degrees of crank angle to an angle that can divide an intake stroke into a plurality of sections, measures at every the predetermined degrees of crank angle at least the pressure downstream of the throttle valve and the time taken for the predetermined degrees of crank angle rotation, estimates the intake air mass flowing from the upstream of the throttle valve to the downstream of the throttle valve at every the predetermined degrees of crank angle, using the pressure downstream of the throttle valve and the time taken for the predetermined degrees of crank angle rotation measured at every the predetermined degrees of crank angle, and integrates the intake air mass at every the predetermined degrees of crank angle for 720 degrees of crank angle rotation, thereby estimating the intake air mass needed for one combustion.

2. The intake air mass estimation apparatus for motorcycle according to claim 1, wherein, in estimating the intake air mass passing through the throttle valve at every the predetermined degrees of crank angle, when the pressure downstream the throttle valve is higher than the pressure upstream of the throttle valve, air is considered to be flowing back from the downstream of the throttle valve to the upstream of the throttle valve, then the intake air mass is calculated with the relationship between the pressure upstream the throttle valve and the pressure downstream of the throttle valve reversed, and, in integrating the intake air mass determined at every the predetermined degrees of crank angle, the integration is performed with the intake air mass of the section in which air is considered to be flowing back made negative.

3. The intake air mass estimation apparatus for motorcycle according to claim 1, wherein the throttle valve upstream pressure detector estimates the pressure upstream of the throttle valve using the pressure downstream of the throttle valve during an intake valve closing period from when an intake valve of a cylinder closes till when the intake valve opens next time.

4. The intake air mass estimation apparatus for motorcycle according to claim 3, wherein, when it is determined that the pressure downstream of the throttle valve has converged to a certain value, the converged value is considered as the pressure upstream of the throttle valve, and when it is determined that the pressure downstream of the throttle valve is increasing toward the pressure upstream of the throttle valve, the pressure upstream of the throttle valve is estimated from the pressure downstream of the throttle valve just before the intake valve opens or the maximum value of the pressure downstream the throttle valve during the intake valve closing period.

5. The intake air mass estimation apparatus for motorcycle according to claim 3, wherein, when it is determined that the pressure downstream of the throttle valve has converged to a certain value, the converged value is considered as the pressure upstream of the throttle valve, and when it is determined that the pressure downstream of the throttle valve is increasing toward the pressure upstream of the throttle valve, the pressure upstream of the throttle valve is estimated from an amount of change in the pressure downstream of the throttle valve per predetermined period.

6. The intake air mass estimation apparatus for motorcycle according to claim 3, wherein an air density calculator for calculating the air density of the intake air mass is provided, and the air density is calculated using the pressure upstream of the throttle valve estimated in claim 3 as the pressure of intake air.

7. The intake air mass estimation apparatus for motorcycle according to claim 1, wherein the flow passage opening area of the throttle valve is set based on the throttle opening.

8. The intake air mass estimation apparatus for motorcycle according to claim 1, wherein the throttle opening is estimated using characteristics data preset based on information on the pressure downstream of the throttle valve and the engine rotation speed.

* * * * *